US009187700B2

(12) United States Patent
Huang et al.

(10) Patent No.: US 9,187,700 B2
(45) Date of Patent: Nov. 17, 2015

(54) METHOD FOR REDUCING COKE DEPOSITION

(75) Inventors: He Huang, Glastonbury, CT (US); Martin Haas, Columbia, CT (US)

(73) Assignee: United Technologies Corporation, Hartford, CT (US)

( * ) Notice: Subject to any disclaimer, the term of this patent is extended or adjusted under 35 U.S.C. 154(b) by 980 days.

(21) Appl. No.: 13/350,108

(22) Filed: Jan. 13, 2012

(65) Prior Publication Data

US 2013/0184510 A1 Jul. 18, 2013

(51) Int. Cl.
*C10G 9/16* (2006.01)
*C10G 9/36* (2006.01)

(52) U.S. Cl.
CPC ..... *C10G 9/36* (2013.01)

(58) Field of Classification Search
CPC ..... C10G 75/00; C10G 75/02; C10G 75/04
USPC ..... 208/47–48 R, 113–120; 134/22.1
See application file for complete search history.

(56) References Cited

U.S. PATENT DOCUMENTS

| | | | | |
|---|---|---|---|---|
| 1,949,588 | A | 3/1934 | Thomas et al. | |
| 2,264,964 | A | 12/1941 | Backoff et al. | |
| 3,849,291 | A | 11/1974 | Owen | |
| 4,418,224 | A | 11/1983 | Bennett et al. | |
| 4,590,307 | A | 5/1986 | Bennett, Jr. et al. | |
| 5,358,626 | A * | 10/1994 | Gandman et al. | 208/48 R |
| 5,567,305 | A | 10/1996 | Jo | |
| 6,228,253 | B1 | 5/2001 | Grandman | |
| 7,334,407 | B2 | 2/2008 | Spadaccini et al. | |
| 7,513,260 | B2 | 4/2009 | Huang | |
| 7,883,674 | B2 | 2/2011 | Huang | |
| 2003/0070963 | A1 * | 4/2003 | Zimmermann et al. | 208/106 |
| 2004/0188323 | A1 * | 9/2004 | Tzatzov et al. | 208/48 R |
| 2004/0256290 | A1 * | 12/2004 | Yamada et al. | 208/120.01 |
| 2007/0261714 | A1 | 11/2007 | Huang | |
| 2007/0266622 | A1 | 11/2007 | Hu | |
| 2008/0156692 | A1 * | 7/2008 | de Rezende Pinho et al. | 208/49 |
| 2008/0257146 | A1 | 10/2008 | Spadaccini et al. | |
| 2010/0199549 | A1 | 8/2010 | Harnar et al. | |
| 2011/0107657 | A1 | 5/2011 | Chen | |

FOREIGN PATENT DOCUMENTS

| | | | |
|---|---|---|---|
| CN | 102041112 | A | 5/2011 |
| WO | 2007003899 | A1 | 1/2007 |
| WO | 2009081204 | A1 | 7/2009 |
| WO | 2011161045 | A1 | 12/2011 |

OTHER PUBLICATIONS

D. Salari et al., "Coke Inhibition During Naphtha Pyrolysis", Iranian Journal of Chemical Engineering, vol. 6. No. (Winter), 2009, IAChE.
The European Search Report mailed Aug. 16, 2013 for European Application No. 13151184.2.

* cited by examiner

*Primary Examiner* — Michelle Stein
(74) *Attorney, Agent, or Firm* — Kinney & Lange, P.A.

(57) ABSTRACT

A method for reducing coke deposits includes heating an alcohol-fuel mixture to decompose alcohol and form water to produce a fuel-water mixture and delivering the fuel-water mixture to a carbon-steam gasification catalyst. The fuel-water mixture reacts with the carbon-steam gasification catalyst such that coke deposits are prevented from remaining in a space near the carbon-steam gasification catalyst.

20 Claims, 5 Drawing Sheets

METHOD FOR REDUCING COKE DEPOSITION

BACKGROUND

When hydrocarbons, a primary component of fuel, are heated to high temperatures the hydrocarbons can decompose to form coke, a solid carbonaceous material. Coke typically consists of approximately 80% to 95% carbon by weight with the balance comprising sulfur, nitrogen, oxygen, hydrogen, and trace amount of inorganic materials (e.g., ash). Coke produced during hydrocarbon decomposition can form deposits on the walls of fuel passages, fuel nozzles and heat exchangers. As these coke deposits build up over time, the flow of fuel through the passage or nozzle can become restricted. Additionally, coke deposits can reduce the effectiveness of heat transfer within heat exchangers. If left unchecked, continued coke deposition on wall surfaces can lead to system failure.

In fluid catalytic cracking applications, coke can be produced in the cracking reactor and deposit on the cracking catalyst, thereby poisoning the cracking catalyst. Coke deposits reduce the effectiveness of the cracking catalyst. Poisoned cracking catalysts must be subjected to costly and intensive regeneration processes in order to improve their effectiveness.

U.S. Pat. No. 7,513,260 ("the '260 patent") describes using water to remove coke deposits from the walls of heat exchangers. According to the '260 patent, water present in a fuel stream reacts with a coke deposit to produce hydrogen and carbon monoxide. This concept provides a useful method of reducing coke deposition. Water is not soluble in the fuel, however, and the method requires the use of a water/steam supply system to incorporate the water into the fuel. This water/steam supply system adds complexity, cost and weight to the overall fuel delivery system.

SUMMARY

A method for reducing coke deposits includes heating an alcohol-fuel mixture to decompose alcohol and form water to produce a fuel-water mixture and delivering the fuel-water mixture to a carbon-steam gasification catalyst. The fuel-water mixture reacts with the carbon-steam gasification catalyst such that coke deposits are prevented from remaining in a space near the carbon-steam gasification catalyst.

A method for preventing coke deposits and removing coke deposits on a fuel passage includes substantially coating a surface of the fuel passage with a carbon-steam gasification catalyst, heating an alcohol-fuel mixture to decompose alcohol and form water to produce a fuel-water mixture and delivering the fuel-water mixture past the fuel passage surface. The fuel-water mixture reacts with the carbon-steam gasification catalyst to prevent formation of coke deposits and remove formed coke deposits on the fuel passage surface.

A method for preventing coke deposition and removing coke from a catalytic cracking system includes preparing a bifunctional catalyst within the fluid catalytic cracking system, combining an alcohol with a hydrocarbon feedstock that is to be cracked to form an alcohol-hydrocarbon mixture, heating the alcohol-hydrocarbon mixture to decompose the alcohol to form water and produce a hydrocarbon-water mixture, and delivering the hydrocarbon-water mixture to the bifunctional catalyst. The bifunctional catalyst includes a cracking catalyst for cracking hydrocarbons and a carbon-steam gasification catalyst. The cracking catalyst reacts with the hydrocarbons in the hydrocarbon-water mixture to break carbon-carbon hydrocarbon bonds. The water in the hydrocarbon-water mixture reacts with the carbon-steam gasification catalyst to prevent formation of coke deposits and remove formed coke deposits from the bifunctional catalyst.

DETAILED DESCRIPTION

A method for reducing or removing coke deposits is described herein. Coke deposits can form on wall surfaces exposed to elevated temperatures and a fuel or catalysts used in fluid catalytic cracking. An alcohol, such as ethanol, is added to the fuel or cracking feedstock. When exposed to the elevated temperatures necessary for the fuel or feedstock to decompose and form coke deposits, the alcohol decomposes, thermally or catalytically, to produce water in situ. The water reacts with a steam-gasification catalyst to remove any nearby coke deposits and prevent the formation of coke deposits. The method described herein removes the need for a water/steam supply subsystem or a catalyst regeneration system, thereby reducing costs and complexity and, in the case of aircraft, weight.

Figure 1:
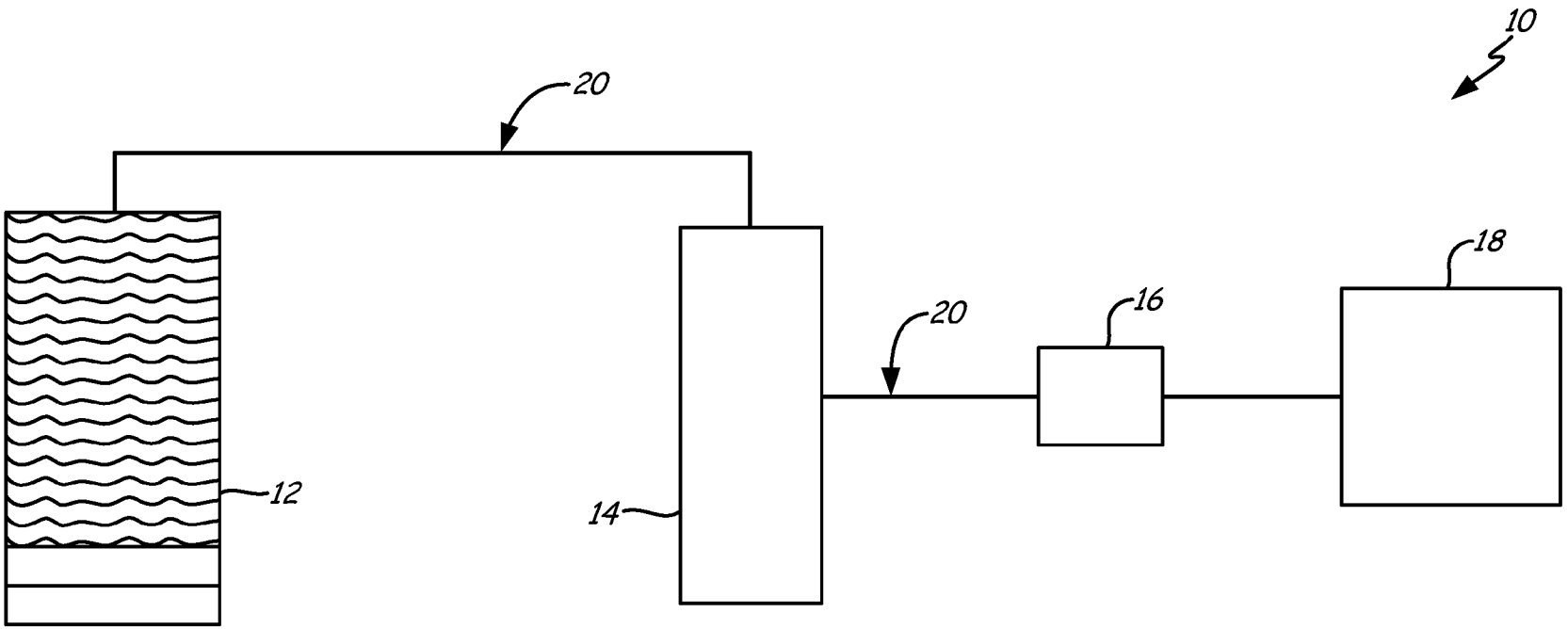
FIG. 1 is a block diagram of a fuel system in which fuel is used as a heat sink.

FIG. 1 illustrates a block diagram of fuel system 10 in which fuel is used as a heat sink. Fuel system 10 can be any system in which fuel is present at elevated operating temperatures. For example, fuel system 10 may be used in gas turbine and hypersonic scramjet applications. Fuel system 10 generally includes fuel reservoir 12, heat exchanger 14, injector 16, combustor 18 and fuel passages 20. Hydrocarbon fuel is stored in fuel reservoir 12 and is pumped to heat exchanger 14 through fuel passages 20 when needed. Heat is transferred to the fuel flowing through heat exchanger 14. The fuel is used as a heat sink, allowing another fluid (e.g., cooling air) or a hot surface (e.g., combustor wall) to be cooled. After the hydrocarbon fuel has been heated, it is passed through injector 16 and delivered to combustor 18. Combustor 18 burns the fuel to generate power or propulsion, depending on the application.

Figure 2:
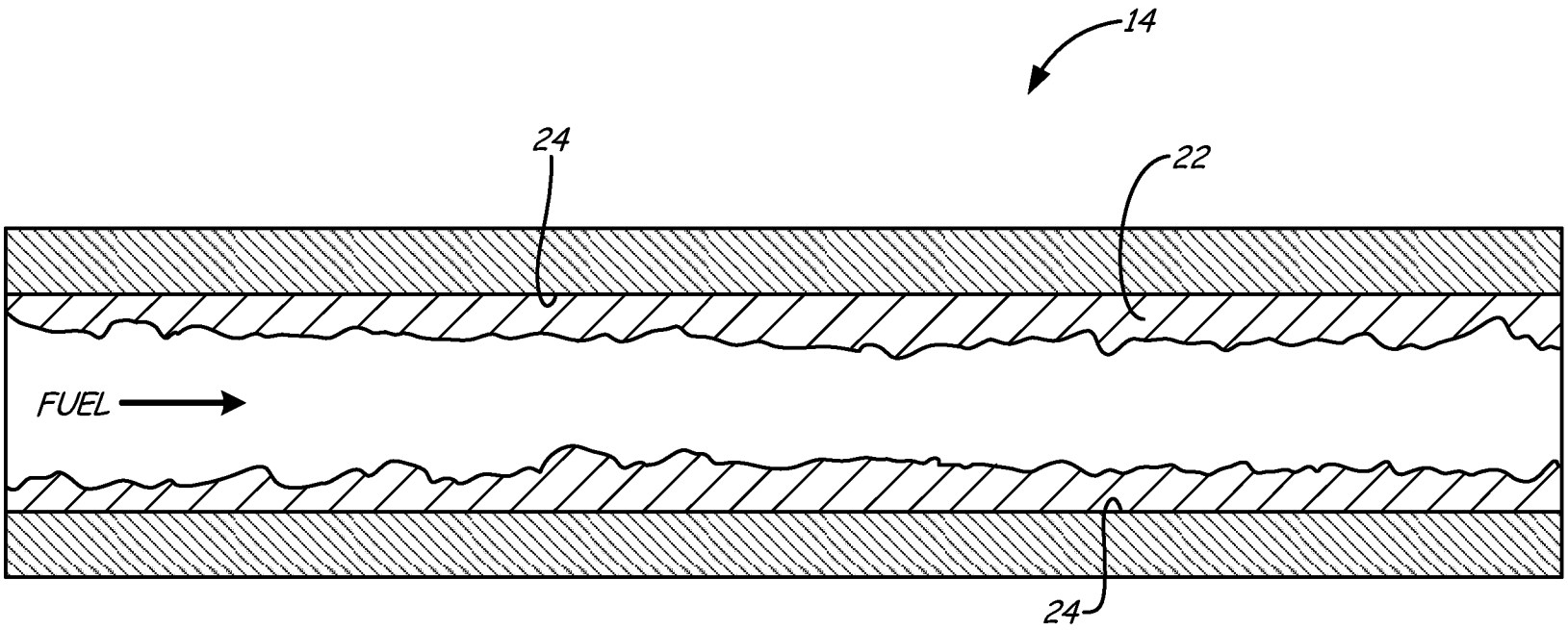
FIG. 2 is a partial cross-sectional view of a fuel passage of the fuel system of FIG. 1 having coke deposits.

FIG. 2 shows a partial cross-sectional view of heat exchanger 14. At high operating temperatures, hydrocarbon fuel is not stable and deposits coke 22, or carbon-rich deposits, on wall surfaces 24 of heat exchanger 14 through which the hydrocarbon fuel passes. As hydrocarbon fuel flows through heat exchanger 14, coke deposits 22 continue to build on wall surfaces 24 of heat exchanger 14. If left unchecked, coke deposits 22 can cause damage and lead to failure of fuel system 10 (shown in FIG. 1). To prevent failure of fuel system 10, coke deposits 22 must be removed from high temperature passages of fuel system 10.

Figure 3:
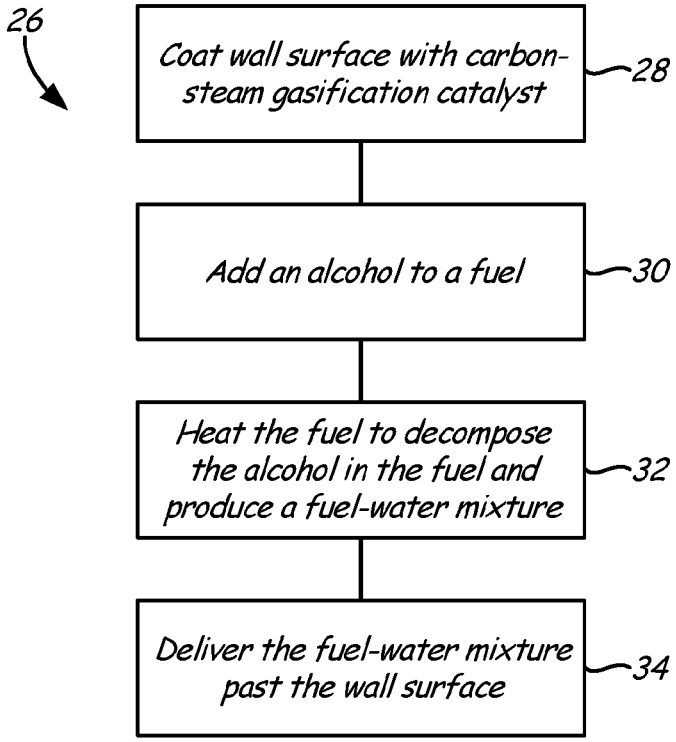
FIG. 3 is a simplified flow diagram of a method for reducing coke deposits from the walls of the fuel system of FIG. 1.

FIG. 3 illustrates a simplified flow diagram of one embodiment of a method for reducing coke deposits from wall surfaces 24 of fuel system 10. Method 26 describes a method for reducing coke deposits using water that is generated from the fuel in situ to react with coke. Method 26 includes coating a wall surface with a carbon-steam gasification catalyst (step 28), adding an alcohol to a fuel (step 30), heating the fuel to decompose the alcohol to form water (step 32) and delivering the formed fuel-water mixture past the wall surface to remove or prevent the formation of coke deposits (step 34). While method 26 is described with particular reference to wall surfaces 24 of heat exchanger 14, coke deposits 22 can also be removed from other high temperature passages of fuel system 10 where coke may deposit, such as fuel passages, fuel nozzles or fuel valves.

In step 28, wall surface 24 is substantially coated with a carbon-steam gasification catalyst. The carbon-steam gasification catalyst is coated on wall surfaces 24 where coke deposits 22 are likely to form due to exposure to both fuel and elevated temperatures. Carbon-steam gasification catalysts allow water and carbon to react to form hydrogen and carbon monoxide. Examples of suitable carbon-steam gasification catalysts include, but are not limited to, alkali metal salts and alkaline earth metal salts. Examples of alkali metal salts include Group 1 elements, such as $Na_2CO_3$, $K_2CO_3$ and $Cs_2CO_3$. Examples of alkaline earth metal salts include Group 2 elements, such as $MgCO_3$, $CaCO_3$, $SrCO_3$ and $BaCO_3$. As described in greater detail below, water is provided to the fuel by decomposition of an alcohol.

In step 30 of method 26, an alcohol is added to the fuel. The alcohol is generally added to the fuel before it reaches a temperature at which coke deposits 22 can form. Generally speaking, any alcohol will be miscible with the fuel used in fuel system 10. Thus, the alcohol can be introduced into the fuel by virtually any means. In exemplary embodiments, the alcohol is added directly to fuel within fuel reservoir 12. Alternatively, the alcohol can be premixed with the fuel before it is added to fuel reservoir 12. In other embodiments, the alcohol can be delivered to the fuel before reaching heat exchanger 14 by an alcohol delivery system that delivers alcohol to a fuel stream. Exemplary alcohols include, but are not limited to, ethanol, propanols, butanols and combinations thereof. Alcohols having longer carbon chains (i.e. more than 4 carbon atoms) can also be used. Primary, secondary and tertiary alcohols are all suitable alcohols. Combining the alcohol(s) and the fuel forms an alcohol-fuel mixture.

In step 32, the combined alcohol-fuel mixture is heated to dehydrate or decompose the alcohol present in the alcohol-fuel mixture. The alcohol-fuel mixture absorbs heat energy in heat exchanger 14. As noted above, the fuel is used as a heat sink to cool another fluid, such as cooling air, or a hot surface, such as a combustor wall. Heat energy is transferred from the hot fluid or hot surface to the fuel in heat exchanger 14.

Alcohol dehydration (or decomposition) is a reaction in which an alcohol decomposes to produce an olefin and water or an ether and water. For example, reactions (1) and (2) shown below illustrate potential ethanol decomposition routes while reaction (3) illustrates a potential t-butanol decomposition route.

$$CH_3CH_2OH \rightarrow CH_2CH_2 + H_2O \quad (1)$$

$$2CH_3CH_2OH \rightarrow CH_3CH_2OCH_2CH_3 + H_2O \quad (2)$$

$$(CH_3)_3COH \rightarrow (CH_3)_2C{=}CH_2 + H_2O \quad (3)$$

In reaction (1), ethanol decomposes to form ethylene ($CH_2CH_2$), an olefin, and water. This reaction is strongly endothermic. In reaction (2), ethanol decomposes to form diethyl ether ($CH_3CH_2OCH_2CH_3$) and water. This reaction is slightly exothermic. In reaction (3), t-butanol decomposes to form isobutylene, an olefin, and water. This reaction is strongly endothermic.

Alcohol can also react to form water in other ways. For example, t-butanol can react with ethanol to produce ethyl t-butyl ether (ETBE) and water as illustrated in reaction (4). ETBE is commonly used as an oxygenate gasoline additive.

$$(CH_3)_3COH + CH_3CH_2OH \rightarrow (CH_3)_3COCH_2CH_3 + H_2O \quad (4)$$

The ETBE formed in reaction (4) can decompose to form isobutylene and ethanol according to reaction (5). This reaction is strongly endothermic. The ethanol formed in reaction (5) can then decompose according to reactions (1) or (2) above, providing additional water.

$$(CH_3)_3COCH_2CH_3 \rightarrow (CH_3)_2C{=}CH_2 + CH_3CH_2OH \quad (5)$$

Reactions (1), (3) and (5) are strong endothermic reactions, resulting in a cooler water-fuel mixture than the incoming alcohol-fuel mixture. This allows the water-fuel mixture to absorb additional heat energy from the other fluid flowing through heat exchanger 14 (e.g., cooling air) or hot surface (e.g., combustor wall), thereby increasing the heat sink capacity of the fuel and improving the cooling efficiency of heat exchanger 14.

Figure 4:
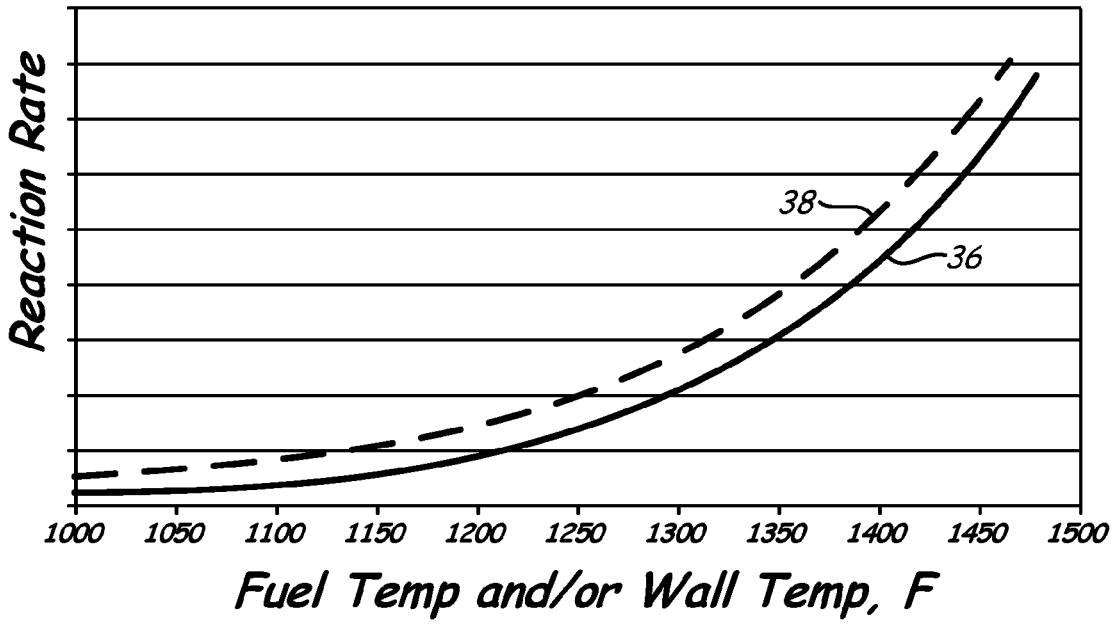
FIG. 4 is a graph showing the rate of coke deposition and the rate of alcohol decomposition as a function of temperature.

In order for the reactions above to occur, the alcohol-fuel mixture must be heated to an elevated temperature. The reactions can occur without the aid of a catalyst (thermally) or with the aid of a catalyst (catalytically). Alcohols in the alcohol-fuel mixture will generally decompose to form water once the alcohol-fuel mixture reaches temperatures above about 426° C. (800° F.) in the absence of a catalyst. The exact temperature at which thermal decomposition begins can depend on the type of alcohol (i.e. ethanol, 2-propanol, etc.) combined with the fuel. The rate of thermal decomposition and the rate of coke deposition are illustrated in FIG. 4 (generally, the rate of catalytic decomposition of alcohol is higher than that of thermal decomposition). FIG. 4 is a graph comparing the rate of coke deposition (curve 36) to the rate of alcohol decomposition (curve 38) as a function of temperature. Both curves 36 and 38 show an exponential increase in the rates of reaction with increased temperature. As temperatures increase, the rate of water formation and the rate of coke deposition increase exponentially. Curve 38, which indicates the rate of thermal decomposition of alcohol, is to the left of curve 36, which indicates the rate of coke deposition. Thus, the rate of alcohol decomposition (and water formation) is generally higher than the rate of coke deposition at a given temperature. Exemplary alcohols for forming water using thermal decomposition include 2-propanol, t-butanol, a mixture of ethanol and t-butanol and combinations thereof.

An alcohol decomposition catalyst can be used to reduce the activation energy of alcohol decomposition and increase selectivity to water formation in step 32. Alcohol decomposition catalysts can benefit virtually any alcohol mixed with the fuel in step 30. In embodiments of method 26 employing an alcohol decomposition catalyst, the catalyst is highly selective for reactions that decompose the alcohol to an olefin and water (e.g., reactions (1) and (3) above).

The alcohol decomposition catalyst is introduced to the fuel in optional step 31. The alcohol decomposition catalyst can be introduced to the fuel in step 31 in a number of ways. In exemplary embodiments, the alcohol decomposition catalyst is added directly to fuel within fuel reservoir 12. Alternatively, the alcohol decomposition catalyst can be premixed with the fuel before it is added to fuel reservoir 12. In other embodiments, the alcohol decomposition catalyst can be delivered to the fuel before reaching heat exchanger 14 by a catalyst delivery system that delivers the alcohol decomposition catalyst to a fuel stream. In embodiments where an alcohol delivery system is used in step 30, the alcohol decomposition catalyst can be introduced to the fuel along with and at the same time as the alcohol. In still other embodiments, the alcohol decomposition catalyst can be coated on wall surfaces 24 of heat exchanger 14 along with the carbon-steam gasification catalyst.

In embodiments where an alcohol decomposition catalyst is used, alcohols in the alcohol-fuel mixture will generally decompose to form water once the alcohol-fuel mixture reaches temperatures above about 370° C. (700° F.). The exact temperature at which catalytic decomposition begins can depend on the type of alcohol (i.e. ethanol, 2-propanol, etc.) combined with the fuel, the strength of the alcohol decomposition catalyst and the amount of alcohol decomposition catalyst present. The alcohol decomposition catalyst enables catalytic alcohol decomposition at a lower temperature than thermal decomposition.

Various alcohol decomposition catalysts can be used to decompose the alcohol in step 32. Catalysis of the alcohol decomposition reaction can be homogeneous or heterogeneous. In exemplary embodiments, the alcohol decomposition catalyst is an acid catalyst. Suitable alcohol decomposition catalysts include zeolites, silica-alumina, heteropolyacid catalysts, transitional metal oxides on an alumina support and combinations thereof. Examples of heteropolyacid catalysts include tungstosilicic acid, tungstophosphoric acid, molybdosilicic acid and molybdophosphoric acid. Various amounts of the alcohol decomposition catalysts can be used. The amount of alcohol decomposition catalyst added to the system can depend on catalyst strength and the site of the catalyst (in the fuel or coated on wall surfaces 24). In exemplary embodiments, the alcohol decomposition catalyst(s) is/are added directly to the fuel at a concentration ranging from about 0.01% by weight to about 0.1% by weight.

Once the alcohol decomposes in step 32, a fuel-water mixture is formed. While the water is not miscible with the fuel, the pressure under which the fuel is delivered through fuel system 10 keeps the water and fuel together in the form of a mixture. At the temperatures normally experienced by fuel system 10, particularly at heat exchanger 14 and farther downstream, the water in the fuel-water mixture is in the form of steam. The byproducts formed during alcohol decomposition (e.g., olefins, ethers, etc.) are generally carried downstream by the fuel to combustor 18 and are suitable for combustion. The byproducts are typically short-chain hydrocarbons and combust more readily than the fuel hydrocarbons, thereby presenting no downstream combustion issues. Furthermore, these byproducts may enhance combustion efficiency.

In step 34, the fuel-water mixture formed in step 32 is delivered past wall surface 24 to remove coke deposits 22 and/or prevent their formation. Coke deposits 22 are removed from wall surface 24 of heat exchanger 14 through catalytic carbon-steam gasification. By coating wall surface 24 with a carbon-steam gasification catalyst in step 28, carbon from coke deposits 22 can react with the water in the fuel to form gaseous hydrogen and carbon monoxide as the fuel-water mixture is delivered past wall surface 24, thereby removing and/or preventing the formation of coke deposits 22 on wall surface 24. Water present in the fuel reacts with the carbon of coke deposits 22 according to the reaction:

$$C_{(coke)}+H_2O \rightarrow H_2+CO \quad (6)$$

Figure 5:
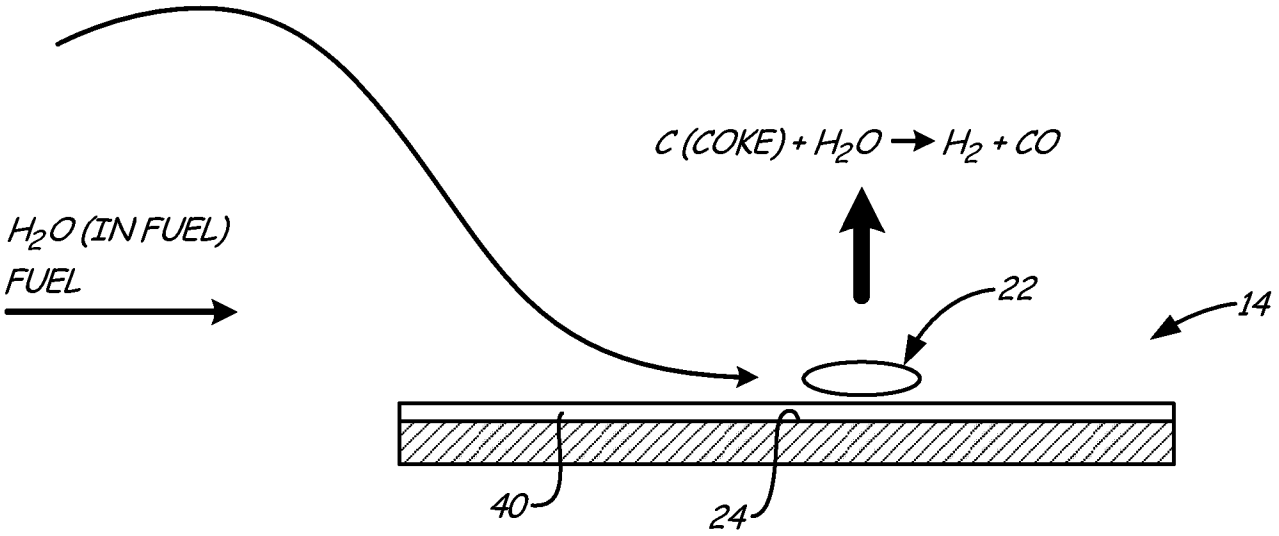
FIG. 5 is schematic representation of a reaction between water in a fuel and a coke deposit on a wall coated with a carbon-steam gasification catalyst.

FIG. 5 illustrates a schematic representation of coke deposit 22 on wall surface 24 of heat exchanger 14 and the chemical reaction at wall surface 24 during catalytic carbon-steam gasification. Prior to passing the fuel-water mixture through heat exchanger 14, carbon-steam gasification catalyst 40 is coated on wall surfaces 24 of heat exchanger 14. Carbon-steam gasification catalyst 40 acts to catalyze the reaction of coke with the steam present into the fuel-water mixture. Since water formation generally occurs at a lower temperature than coke formation as noted above, water is already present in the fuel when coke begins to form and deposit on wall surface 24. Any coke near carbon-steam gasification catalyst 40 can react with water to produce hydrogen and carbon monoxide before a coke deposit can form on wall surface 24, thereby preventing formation of coke deposits 22. The hydrocarbon fuel, hydrogen and carbon monoxide are combusted downstream as fuel in combustor 18.

The amount of alcohol added to the fuel in step 30 can vary depending on the amount of water needed to remove coke deposits and the type of alcohol added to the fuel. Generally speaking, the amount of water present in the fuel is kept to a minimum. Ideally, the fuel contains only enough water to sufficiently remove coke deposits 22 from wall surface 24; surplus water does not provide substantial downstream benefits. Depending on the application (i.e. high rate of coke formation, high temperature, etc.), exemplary embodiments of method 26 will require a fuel-water mixture having between about 0.1% water by weight and about 2% water by weight. In particularly exemplary embodiments, the fuel-water mixture has between about 0.5% water by weight and about 2% water by weight. Since an alcohol has a greater molecular weight than water, the amount of alcohol added to the fuel in step 30 is greater than the desired water concentration. Table 1 below illustrates the amounts of various alcohols needed to obtain water concentrations of 0.1%, 0.5%, 1% and 2% by weight. Table 1 assumes that all alcohol present in the alcohol-fuel mixture decomposes. At the temperatures described above, virtually all of the alcohol present in the alcohol-fuel mixture will decompose to form water.

TABLE 1

| | Alcohol (% by weight) needed to reach the listed $H_2O$ weight % | | | |
|---|---|---|---|---|
| | 0.1% $H_2O$ by weight | 0.5% $H_2O$ by weight | 1% $H_2O$ by weight | 2% $H_2O$ by weight |
| Ethanol | 0.26 | 1.28 | 2.60 | 5.10 |
| 1-Propanol | 0.33 | 1.67 | 3.34 | 6.68 |
| 2-Propanol | 0.33 | 1.67 | 3.34 | 6.68 |
| t-Butanol | 0.41 | 4.12 | 2.06 | 8.24 |

Alcohol that is not decomposed in step 30 can also form radicals and directly attack coke deposits via the following reactions:

$$R—OH \rightarrow R.+HO. \quad (7)$$

$$HO.+C_{(coke)} \rightarrow CO+H. \quad (8)$$

Hydroxyl radicals formed from the undecomposed alcohol can react with coke deposits to form carbon monoxide and hydrogen radicals.

In addition to providing a source of water used to remove coke deposits, some alcohols, such as ethanol, confer additional benefits to fuel system 10. For example, as described above, the decomposition of ethanol (and other alcohols) is strongly endothermic, resulting in a cooler water-fuel mixture than the incoming alcohol-fuel mixture. The cooler water-fuel mixture can absorb additional heat energy from the cooling fluid in heat exchanger 14, improving the heat sink capacity of the fuel. The addition of ethanol to the fuel also lowers the fuel's initial boiling point. The reduced boiling point may enable a lower cold-start Mach number. The addition of ethanol to the fuel also lowers the fuel's freezing point, reducing the potential for problems associated with fuel at or below its cloud point in cold environments.

By generating water in situ from an alcohol, method 26 removes the need for a separate water/steam subsystem to provide water to the fuel stream. Eliminating the water/steam subsystem reduces the complexity of fuel system 10 and removes the costs and weight added by a water/steam subsystem.

The concepts described above can also be applied to fluid catalytic cracking processes used in petroleum refining and other petroleum industry applications. Fluid catalytic cracking is used to convert high-boiling, high-molecular weight hydrocarbon fractions of petroleum crude oils to gasoline, olefinic gases and other products more valuable than crude oil. In general, the fluid catalytic cracking process vaporizes and breaks the long-chain molecules of high-boiling hydrocarbon liquids into much shorter molecules by contacting a crude oil feedstock, at high temperature and moderate pressure, with a fluidized powdered cracking catalyst.

In one embodiment of a normal fluid catalytic cracking process, preheated high-boiling petroleum feedstock containing long-chain hydrocarbon molecules is injected into a catalyst riser where the hydrocarbon feedstock is vaporized and cracked into smaller vapor molecules by contacting and mixing with a hot powdered catalyst. The hydrocarbon vapors fluidize the powdered catalyst and the mixture of hydrocarbon vapors and catalyst flows upward to enter a reactor. The reactor is a vessel in which the cracked product vapors are separated from the spent catalyst using cyclones within the reactor. The spent catalyst flows through a steam stripping section to remove any hydrocarbon vapors before the spent catalyst returns to a catalyst regenerator. The cracking reactions produce carbonaceous material (coke) that deposits on the catalyst and quickly reduces the catalyst's reactivity. The catalyst is regenerated by burning off the deposited coke with air blown through the regenerator.

Because the coke deposits poison the cracking catalysts, a separate catalyst regeneration process is required. The regeneration process requires removing the spent catalyst from the riser and reactor and heating the spent catalyst in a catalyst regenerator. Additionally, some of the spent catalyst sent to the catalyst regenerator cannot be properly regenerated. The process of burning off the deposited coke can adversely affect the catalyst's activity. The catalyst can be damaged by the high temperatures. For instance, the high temperatures required for catalyst regeneration can result in blocked pores on the catalyst material, reducing the availability of potential catalysis sites.

Figure 6:
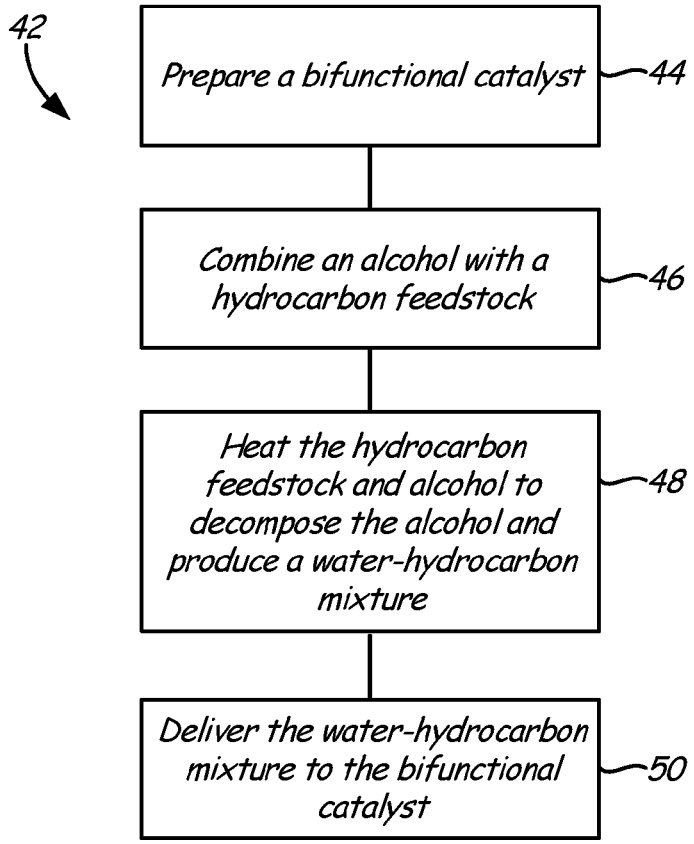
FIG. 6 is a simplified flow diagram of a method for reducing coke deposits from catalysts of a fluid catalytic cracking system.

FIG. 6 shows a simplified flow diagram of one embodiment of a method for reducing coke deposits from catalysts of a fluid catalytic cracking system. Method 42 can be used to remove coke deposits from the catalysts used in fluid catalytic cracking applications without the need for a separate catalyst regeneration system, providing significant savings in capital and operational costs. Method 42 includes preparing a bifunctional catalyst (step 44), combining an alcohol with a hydrocarbon feedstock (step 46), heating the feedstock and alcohol to decompose the alcohol to form water and produce a hydrocarbon-water mixture (step 48) and delivering the formed hydrocarbon-water mixture to the bifunctional catalyst (step 50). While method 42 is described with particular reference to fluid catalytic cracking systems, coke deposits can also be removed from other high temperature cracking systems where coke is formed.

In step 44, a bifunctional catalyst is prepared. A bifunctional catalyst includes a cracking catalyst and a carbon-steam gasification catalyst. The bifunctional catalyst provides for hydrocarbon cracking and the removal and/or prevention of coke deposits on the bifunctional catalyst. The cracking catalyst reacts with the hydrocarbon feedstock to break carbon-carbon bonds and crack hydrocarbons. The cracking catalyst can be any catalyst normally used in fluid catalytic cracking operations. Cracking catalysts include zeolites, alumina, silica and combinations thereof. As described above, the carbon-steam gasification catalyst enables water or steam to react with carbon to produce gaseous hydrogen and carbon monoxide according to reaction (6) above. The reaction between water and carbon (coke) prevents or removes coke deposits from the bifunctional catalyst, including the cracking catalyst.

In the fluid catalytic cracking example described above, the cracking catalyst is fluidized by the vaporized hydrocarbon feedstock and the hydrocarbons are cracked in the catalytic riser. Method 42 removes the need for a separate catalyst regeneration process. Thus, the cracking catalyst does not need to be removed and regenerated from the vaporized hydrocarbon feedstock stream. Instead, the bifunctional catalyst, which includes the cracking catalyst, can be positioned within the fluid catalytic cracking system and remain stationary. For example, the bifunctional catalyst can be placed within a fixed bed through which the vaporized hydrocarbon feedstock stream is passed. As described in greater detail below, the hydrocarbons and the water present in the vaporized hydrocarbon feedstock stream react with the cracking catalyst and the carbon-steam gasification catalyst, respectively. The cracking catalyst of the bifunctional catalyst provides for the breaking of hydrocarbon carbon-carbon bonds and cracking. The carbon-steam gasification catalyst of the bifunctional catalyst provides for the removal of any coke deposits on the cracking catalyst of the bifunctional catalyst. In this manner, the bifunctional catalyst can theoretically operate indefinitely as long as water is available in the feedstock stream to prevent coke deposits on the cracking catalyst.

Steps 46 and 48 are similar to steps 30 and 32, respectively. In step 46, an alcohol is combined with a hydrocarbon feedstock that is to be cracked to form an alcohol-hydrocarbon mixture. The alcohols listed above with respect to step 30 are also suitable for use in step 46. In step 48, the alcohol-hydrocarbon mixture is heated to decompose the alcohol and form water to produce a water-hydrocarbon mixture. The alcohol-hydrocarbon mixture is heated to a temperature greater than about 370° C. (700° F.) to decompose the alcohol. Most cracking catalysts are highly selective for allow the alcohol to decompose to form an olefin and water as described in reactions (1) and (3) above. No separate alcohol decomposition catalyst is needed.

Step 50 is similar to step 34 described above. In step 50, the water-hydrocarbon mixture is delivered to the bifunctional catalyst where contents of the water-hydrocarbon mixture react with the catalyst. Instead of just water reacting with the catalyst as in step 34, however, both the hydrocarbons and water react with the bifunctional catalyst. At the bifunctional catalyst, the hydrocarbons are cracked with the aid of the cracking catalyst. Meanwhile, the water prevents the formation of or removes coke deposits from the bifunctional catalyst as described in reaction (6) above. After the hydrocarbons are cracked in step 50, the cracked hydrocarbons are delivered to a downstream processing unit, such as a distillation column, where they are separated and collected.

The water present in the water-hydrocarbon mixture prevents the poisoning of the bifunctional catalyst, which includes the cracking catalyst, due to coke deposition. Utilizing a bifunctional catalyst having a carbon-steam gasification catalyst and generating water within the hydrocarbon feedstock stream removes the need for cyclones, the steam stripping section and the catalyst regenerator. Thus, method 42 eliminates the need for a separate cracking catalyst regeneration step, reducing both capitol and operational costs associated with the catalytic cracking process.

Figure 7:
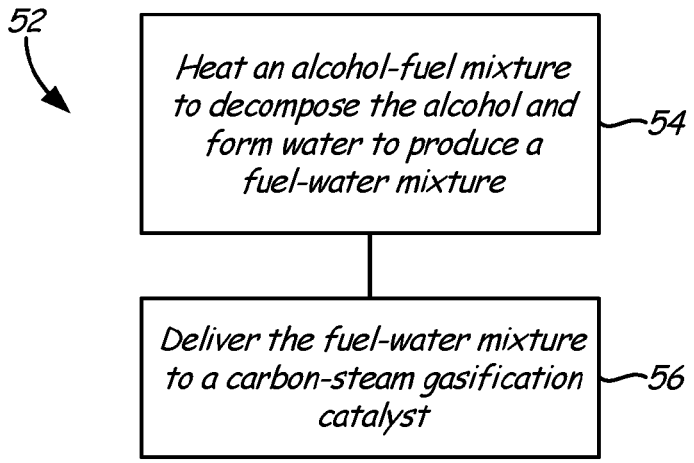
FIG. 7 is a simplified flow diagram of a general method for reducing coke deposits.

FIG. 7 illustrates a simplified flow diagram of one embodiment of a general method for reducing coke deposits. Method 52 includes heating an alcohol-fuel mixture to decompose alcohol and form water to produce a fuel-water mixture in step 54 and delivering the fuel-water mixture to a carbon-steam gasification catalyst in step 56. Step 54 proceeds as described above in step 32. Step 56 proceeds as described above in step 34. The fuel-water mixture reacts with the carbon-steam gasification catalyst such that coke deposits are prevented from remaining in a space near the carbon-steam gasification catalyst.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A method for reducing coke deposits, the method comprising:

combining an alcohol with a fuel to produce an alcohol-fuel mixture;

heating the alcohol-fuel mixture to decompose alcohol and form water to produce a fuel-water mixture, wherein heating the alcohol-fuel mixture occurs prior to introduction of a carbon-steam gasification catalyst; and delivering the fuel-water mixture to the carbon-steam gasification catalyst, wherein the fuel-water mixture reacts with the carbon-steam gasification catalyst such that coke deposits are prevented from remaining in a space near the carbon-steam gasification catalyst.

2. The method of claim 1, wherein the carbon-steam gasification catalyst coats a wall surface such that coke deposits are prevented from remaining on the wall surface.

3. The method of claim 2, wherein the wall surface belongs to a component selected from the group consisting of a heat exchanger, a transfer line and a nozzle.

4. The method of claim 1, wherein the carbon-steam gasification catalyst and a cracking catalyst form a bifunctional catalyst such that coke deposits are prevented from remaining on the bifunctional catalyst.

5. The method of claim 1, wherein the alcohol-fuel mixture is formed by adding an alcohol to a hydrocarbon fuel.

6. The method of claim 1, wherein the carbon-steam gasification catalyst is selected from the group consisting of $Na_2CO_3$, $K_2CO_3$, $Cs_2CO_3$, $MgCO_3$, $CaCO_3$, $SrCO_3$, $BaCO_3$ and combinations thereof.

7. The method of claim 1, wherein the alcohol-fuel mixture is heated to a temperature of greater than about 426° C. (800° F.) to decompose the alcohol.

8. The method of claim 7, wherein the alcohol is selected from the group consisting of ethanol, 2-propanol, t-butanol and combinations thereof.

9. The method of claim 1, further comprising:

adding an alcohol decomposition catalyst to the alcohol-fuel mixture before heating the alcohol-fuel mixture to decompose the alcohol.

10. The method of claim 9, wherein the alcohol decomposition catalyst is selected from the group consisting of zeolites, silica-alumina, heteropolyacid catalysts, transitional metal oxides on an alumina support and combinations thereof.

11. The method of claim 9, wherein the alcohol-fuel mixture comprises between about 0.01% and about 0.1% alcohol decomposition catalyst by weight.

12. The method of claim 9, wherein the alcohol-fuel mixture is heated to a temperature of greater than about 370° C. (700° F.) to decompose the alcohol.

13. The method of claim 9, wherein the alcohol is selected from the group consisting of ethanol, propanols, butanols and combinations thereof.

14. The method of claim 1, wherein the alcohol-fuel mixture, before heating the alcohol-fuel mixture to decompose the alcohol, comprises between about 0.3% and about 8.2% alcohol by weight, and wherein the fuel-water mixture comprises between about 0.1% and about 2% water by weight.

15. A method for preventing coke deposits on and removing coke deposits from a fuel passage, the method comprising:

substantially coating a surface of the fuel passage with a carbon-steam gasification catalyst;

combining an alcohol with a fuel to produce an alcohol-fuel mixture;

heating the alcohol-fuel mixture to decompose alcohol and form water to produce a fuel-water mixture, wherein heating the alcohol-fuel mixture occurs prior to introduction of the carbon-steam gasification catalyst; and delivering the fuel-water mixture past the fuel passage surface, wherein the fuel-water mixture reacts with the carbon-steam gasification catalyst to prevent formation of coke deposits and remove formed coke deposits on the fuel passage surface.

16. The method of claim 15, wherein the alcohol-fuel mixture is heated to a temperature of greater than about 426° C. (800° F.) to decompose the alcohol.

17. The method of claim 15, further comprising:

adding an alcohol decomposition catalyst to the alcohol-fuel mixture before heating the alcohol-fuel mixture to decompose the alcohol, wherein the alcohol-fuel mixture is heated to a temperature of greater than about 370° C. (700° F.) to decompose the alcohol.

18. The method of claim 17, wherein the alcohol decomposition catalyst is selected from the group consisting of zeolites, silica-alumina, heteropolyacid catalysts, transitional metal oxides on an alumina support and combinations thereof.

19. A method for preventing coke deposition and removing coke from a catalytic cracking system, the method comprising:

preparing a bifunctional catalyst within the fluid catalytic cracking system, the bifunctional catalyst comprising:

a cracking catalyst for cracking hydrocarbons; and a carbon-steam gasification catalyst;

combining an alcohol with a hydrocarbon feedstock that is to be cracked to form an alcohol-hydrocarbon mixture;

heating the alcohol-hydrocarbon mixture to decompose the alcohol to form water and produce a hydrocarbon-water mixture, wherein heating the alcohol-hydrocarbon mixture occurs prior to introduction of the bifunctional catalyst; and delivering the hydrocarbon-water mixture to the bifunctional catalyst, wherein the cracking catalyst reacts with the hydrocarbons in the hydrocarbon-water mixture to break carbon-carbon hydrocarbon bonds and the water in the hydrocarbon-water mixture reacts with the carbon-steam gasification catalyst to prevent formation of coke deposits and remove formed coke deposits from the bifunctional catalyst.

20. The method of claim 19, wherein the cracking catalyst is selected from the group consisting of zeolites, alumina, silica and combinations thereof, and wherein the carbon-steam gasification catalyst is selected from the group consisting of $Na_2CO_3$, $K_2CO_3$, $Cs_2CO_3$, $MgCO_3$, $CaCO_3$, $SrCO_3$, $BaCO_3$ and combinations thereof.

* * * * *